United States Patent [19]

Generali

[11] 4,369,830

[45] Jan. 25, 1983

[54] SEALING JOINTS IN MOULDS

[75] Inventor: Marcel Generali, Chilly-Mazarin, France

[73] Assignee: Foseco International Limited, Birmingham, England

[21] Appl. No.: 233,375

[22] Filed: Feb. 11, 1981

[51] Int. Cl.[3] ..... B22D 7/08

[52] U.S. Cl. ..... 164/137; 249/174; 249/204; 403/265; 403/292

[58] Field of Search ..... 164/137, 412; 249/174, 249/204; 277/DIG. 6, 166, 206 R, 213, 231; 403/292, 265; 206/813, 219

[56] References Cited

U.S. PATENT DOCUMENTS

| | | | |
|---|---|---|---|
| 741,808 | 10/1903 | Miner | 277/231 X |
| 854,135 | 5/1907 | Whittemore | 277/231 X |
| 1,683,941 | 9/1928 | Wirfs | 277/166 X |
| 2,580,546 | 1/1952 | Hobson, Jr. | 277/231 X |
| 3,722,898 | 3/1973 | von Benningsen | 277/206 |

FOREIGN PATENT DOCUMENTS

| | | | |
|---|---|---|---|
| 2391793 | 12/1978 | France | 164/137 |
| 984596 | 2/1965 | United Kingdom . | |
| 1161109 | 8/1969 | United Kingdom . | |
| 1324049 | 7/1973 | United Kingdom . | |
| 1404312 | 8/1975 | United Kingdom . | |

*Primary Examiner*—Nicholas P. Godici
*Assistant Examiner*—J. Reed Batten, Jr.
*Attorney, Agent, or Firm*—Cushman, Darby & Cushman

[57] ABSTRACT

A method of sealing a joint between component parts of a metal mould for metal casting comprises applying in the area where the seal is desired an elongated sealing element and a compressible cover separating the sealing element from each of the surfaces to be sealed together. The method is especially useful for sealing the joint between an ingot mould for steel ingots and a base plate for the mould.

5 Claims, 5 Drawing Figures

Figure 1:
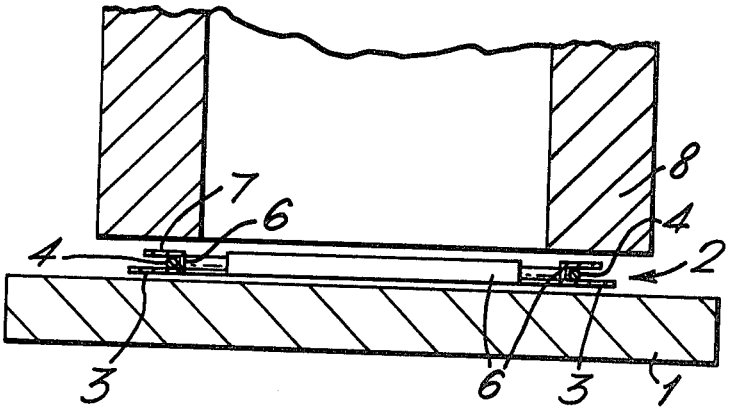

FIG.3.
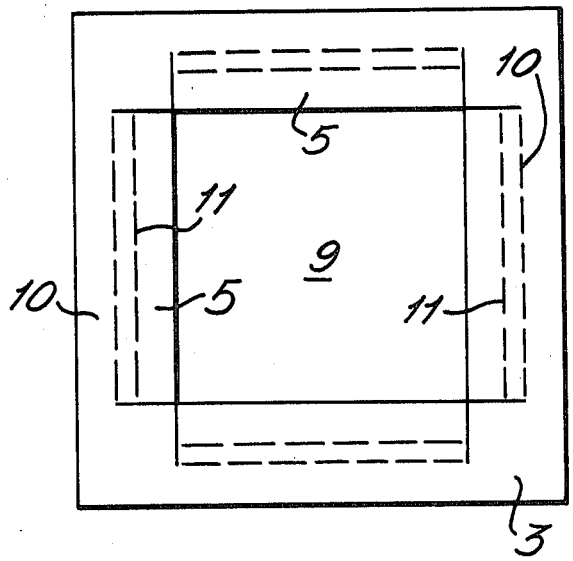
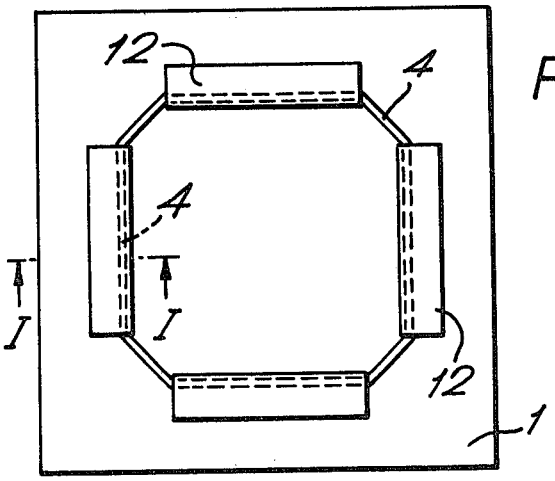
FIG.4.
FIG.5.
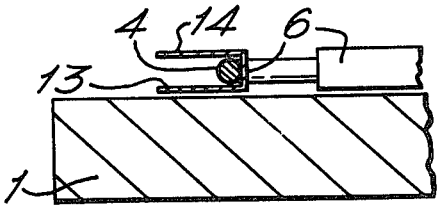

SEALING JOINTS IN MOULDS

This invention concerns sealing joints between component parts of moulds made of metal and for casting metal, especially ingot moulds e.g. for steel ingots.

Ingot moulds may have a portion providing side walls and a separate portion (a base plate) on which the former portion stands. Also, at the top of an ingot mould there may be provided a separate head box. For various reasons it is desirable to form a good seal between the underside of the side walls of an ingot mould and the base plate and between the top surface of the side walls and the underside of the head box.

It is known from, for example, British Patent Specification Nos. 1,161,109 and 1,404,312 that seals of the above type may be formed by use of a sealing element comprising a sealant within a deformable tubular container. The sealing element is placed in an appropriate position on one of the surfaces between which a seal is desired and is then compressed to form a seal between the surfaces by bringing the surfaces together in the desired relative positions with the sealing element between them.

According to the present invention a method of sealing a joint between component parts of a metal mould for metal casting comprises applying in the area where the seal is desired an elongated sealing element, the sealing element being separated from each of the surfaces to be sealed together by a compressible cover.

Known tubular sealing elements tend after use to leave an undesirable residue on the surfaces sealed together and this residue may be difficult to remove. Furthermore, elongated sealing elements can be difficult to position correctly. In particular, considerable difficulty may arise when, as is often the case, the sealing element has to be positioned on a hot surface e.g. an ingot mould base plate which is still hot from a previous casting operation.

In the method of the present invention the compressible cover is preferably of cardboard or the like and this prevents the sealing element coming into direct contact with the surfaces to be sealed together. However, the cardboard is sufficiently deformable that a good seal can still be obtained. In use the cardboard or the like may become charred or otherwise degraded to a greater or lesser extent but the residue still serves to achieve the desired separation. Furthermore, the cardboard or residue thereof is easy to remove after use from the surfaces that were sealed together and permits ready removal at the same time of the sealing element or its residues.

The sealing element may comprise a sealant in a deformable tubular container and the container may be designed to rupture in use but even so the cardboard still serves its separating function.

The cover may comprise a sheet of cardboard suitably placed below and on top of the sealing element. Preferably however the cover is of one piece and comprises a sheet of cardboard cut to have an inside aperture corresponding in shape and size to the aperture of the mould, a flap being rooted to the inner edge of the aperture and the flap being folded over outwardly where it is rooted to the sheet to define a space to receive the sealing element.

By use of suitably shaped covers the method of the invention enables the elongated sealing element readily to be correctly positioned.

The invention includes a mould having parts sealed together by the method of the invention, a method of casting a metal in which such a mould is used and a casting made by this method.

The sealing element may be as described in either of the above-mentioned British Patent Specifications. In another preferred embodiment the sealing element is a length of entangled metal fibres. The entangled metal fibres are preferably in the form of steel wool. The length of metal fibers may be continuous or may comprise a succession of adjacent entangled metal fibre pads held together as a length e.g. by a steel wire passing through the pads in turn. The pads may be circular in section and it is particularly preferred to use a succession of such pads held together end to end. Use of e.g. steel fibres in the case of casting a steel ingot means that the length of fibres undergoes virtually no change, apart from compression, during the casting process. Thus, not only is a good seal obtainable but also there is no risk of the steel being cast being contaminated by matter from the length of fibres. In addition to the advantages already mentioned the method of the invention enables particularly good seals to be obtained.

Figure 2:
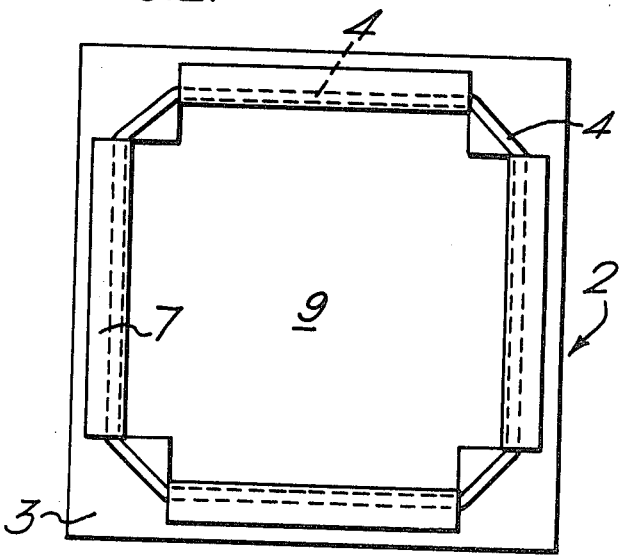

This invention is further described with reference to the accompanying diagrammatic drawings in which:

FIG. 1 is a vertical section through the centre of an ingot mould base plate on which is a sealing system in accordance with the invention, and part of an ingot mould about to be positioned on the sealing system on the base plate, FIG. 2 is a plan of the sealing system in FIG. 1, FIG. 3 is a plan of the sealing system of FIGS. 1 and 2 before its preparation for use has been completed, FIG. 4 is a plan of an ingot mould base plate on which is an alternative sealing system of the invention and FIG. 5 is an enlarged vertical section along line I—I in FIG. 4.

Referring to FIG. 3, a sheet of cardboard 3 has an aperture 9 through it and four outwardly foldable inner portions or flaps 5. To make the sheet ready for use the flaps are folded upwardly about fold lines 10 where the flaps are rooted to the rest of the cardboard sheet. An elongated sealing element 4 (see FIG. 2) e.g. comprising deformable refractory material within a deformable tubular container is then placed on the sheet in a ring about the upwardly folded flaps 5 and the originally innermost part of each flap 5 is then folded about fold line 11 over the sealing element 4, thereby providing pieces of cardboard 7 extending over the sealing element 4 but leaving upstanding pieces of cardboard 6 (see FIG. 1) of a height similar to the thickness of the sealing element. By this means a sealing system 2 as shown in FIG. 2 is obtained.

The sealing system as shown in FIG. 2 is then placed on ingot mould base plate 1 as shown in FIG. 1. In FIG. 1 for clarity the sealing system is shown upwardly spaced from the base plate but would in fact rest on it.

The procedure described above may be varied in a number of respects. For example, the sealing element 4 may be suitably positioned on the sheet 3 before any folding of the flaps 5 is effected and the folding then done and rather than folding along two distinct fold lines a rounded fold may be formed. Also, if the base plate is relatively cool, the sheet 3, optionally together with the sealing element, may be put on the base plate before some or all of the folding is done.

On placing ingot mould 8 (see FIG. 1) on the assembled sealing system on the base plate 1 the sealing system is deformed and a good seal obtained. After casting, the residue of the sealing system is easily removed from the sealed surfaces.

As shown in FIG. 4, the sealing system may comprise four folded lengths of cardboard 12 each generally corresponding in length to the inner length of one side wall of the mould at its lower end and a sealing element 4 as described above passing through each fold. Each of the lengths 12 has a portion 13 (see FIG. 5) in contact with the base plate 1, an upstanding portion 6, created by a first fold, and a portion 14 overlying the sealing element, created by a second fold.

The lengths 12 in unfolded condition may be placed on the base plate 1, the sealing element 4 then positioned on them, the lengths then folded and the mould then positioned on the sealing system. Instead, the sealing element 4 may first be placed on the base plate 1 and the lengths 12 then put in place in pre-folded form or in unfolded form and then folded. However the sealing system is assembled, once the mould is positioned on it, and thereby deforms it, a good seal is obtained and, after casting, the residue is easily removed.

I claim:

1. A method of sealing a joint between component parts of a metal mould for metal casting, utilizing an elongated sealing element which comprises a deformable sealant within a deformable tubular container, and a compressible sheet material cover, comprising the steps of: applying, in the area where the seal is desired between the parts of the metal mould, the elongated sealing element; and disposing the compressible sheet material cover so that it separates the sealing element from each of the surfaces to be sealed together.

2. A method according to claim 1 in which the compressible cover is of cardboard.

3. A method according to claim 1 in which the sealing element and the compressible cover are applied in the area between the base of an ingot mould and a base plate for the mould.

4. A method according to claim 3 in which the compressible cover is of one piece and comprises a sheet of compressible material having an aperture corresponding in shape and size to the opening at the base of the mould, a flap being rooted to the inner edge of the aperture and folded over outwardly where it is rooted to the sheet to define a space to receive the sealing element.

5. A method as recited in claims 1 or 4 comprising the further step of bringing the mould parts together to deform the sealing element and compress the sheet material cover; pouring a metal casting; moving the metal parts of the mould apart; removing the castings discarding the sealing element and compressible sheet material; and placing a new sealing element and compressible sheet material cover in place between the mould parts.

* * * * *